US010435129B1

(12) United States Patent
Corcoran

(10) Patent No.: US 10,435,129 B1
(45) Date of Patent: Oct. 8, 2019

(54) WATERCRAFT WITH COMPRESSED AIR PROPULSION SYSTEM

(71) Applicant: John F. Corcoran, Hyannis, MA (US)

(72) Inventor: John F. Corcoran, Hyannis, MA (US)

(73) Assignees: Mary A. Corcoran, Hyannis, MA (US); Ellen T. Corcoran, Hyannis, MA (US)

( * ) Notice: Subject to any disclaimer, the term of this patent is extended or adjusted under 35 U.S.C. 154(b) by 0 days.

(21) Appl. No.: 16/103,142

(22) Filed: Aug. 14, 2018

(51) Int. Cl.

| | |
|---|---|
| ***B63H 21/16*** | (2006.01) |
| ***B63H 16/08*** | (2006.01) |
| ***B63H 7/00*** | (2006.01) |
| ***B63H 21/165*** | (2006.01) |
| ***B63H 1/14*** | (2006.01) |
| ***B63H 19/00*** | (2006.01) |
| ***F15B 1/26*** | (2006.01) |
| ***F01B 23/04*** | (2006.01) |
| ***F04D 25/06*** | (2006.01) |
| ***F04D 25/08*** | (2006.01) |
| ***B63H 21/21*** | (2006.01) |

(52) U.S. Cl.
CPC ..... *B63H 21/165* (2013.01); *B63H 1/14* (2013.01); *B63H 7/00* (2013.01); *B63H 16/08* (2013.01); *B63H 19/00* (2013.01); *B63H 21/21* (2013.01); *F01B 23/04* (2013.01); *F04D 25/0673* (2013.01); *F04D 25/08* (2013.01); *F15B 1/265* (2013.01)

(58) Field of Classification Search
CPC ..... B63H 16/00; B63H 16/08; B63H 7/00; B63H 23/00; B63H 23/26
USPC ..... 440/23, 61 R
See application file for complete search history.

(56) References Cited

U.S. PATENT DOCUMENTS

| | | | | |
|---|---|---|---|---|
| 1,626,736 | A * | 5/1927 | Johnston | B63H 23/00 440/5 |
| 4,163,367 | A | 8/1979 | Yeh | |
| 4,850,907 | A * | 7/1989 | Mula | B63H 16/08 440/23 |
| 6,619,224 | B1 | 9/2003 | Syfritt | |
| 8,225,900 | B2 | 7/2012 | Domes | |
| 9,856,853 | B2 | 1/2018 | French | |
| 2004/0237517 | A1 | 12/2004 | Cho et al. | |
| 2009/0032315 | A1 | 2/2009 | Porter | |

(Continued)

FOREIGN PATENT DOCUMENTS

| | | | |
|---|---|---|---|
| EP | 1713684 | B1 | 11/2010 |
| WO | 2009131707 | A9 | 10/2009 |

*Primary Examiner* — Lars A Olson
(74) *Attorney, Agent, or Firm* — Hansen IP Law PLLC

(57) ABSTRACT

A watercraft comprising a compressed air propulsion system is shown and described. The watercraft includes at least one propeller operatively connected to an air motor. Storage tanks supply compressed air having a pressure of at least 2000 psi to a pressure regulator that reduces the pressure and supplies air to an air control valve. User controls adjust the air control valve to adjust the flow rate of air to the air motor which in turn adjusts the direction and/or speed of rotation of the propeller. An on-board air compressor energized by a plurality of lithium iron phosphate batteries provides air to the air storage tanks when the pressure falls below a specified value. In certain examples, the electric and air propulsion system is used to replace a fossil fuel engine in an existing watercraft and can remain at sea longer than the existing watercraft.

24 Claims, 2 Drawing Sheets

(56) References Cited

U.S. PATENT DOCUMENTS

| | | | |
|---|---|---|---|
| 2009/0249775 | A1 | 10/2009 | Murakami et al. |
| 2011/0014828 | A1 | 1/2011 | Domes |
| 2014/0223896 | A1 | 8/2014 | Zhou et al. |
| 2016/0194056 | A1 | 7/2016 | Chang |

* cited by examiner

WATERCRAFT WITH COMPRESSED AIR PROPULSION SYSTEM

FIELD

This disclosure relates to watercraft propulsion systems, and more specifically, watercraft that are propelled by compressed air instead of fossil fuels.

DESCRIPTION OF THE RELATED ART

Like other forms of transportation, many watercraft (boats, ships, submarines, jet skis, etc.) rely on fossil fuel engines for power. However, fossil fuel engines have numerous disadvantages. Because they are non-renewable and because of the cost of mitigating their environmental impacts, fossil fuel prices have continued to rise steadily over the last several decades. Depending on its quality, fossil fuel combustion can release pollutants such as carbon monoxide, sulfur oxides, and nitrogen oxides into the atmosphere. In addition, the combustion of even the cleanest burning fossil fuels produces carbon dioxide which contributes to the increasing problem of climate change. Fossil fuels also release heat when burned, which represents wasted energy that cannot be recovered and which requires a radiator and coolant system to prevent engine damage. As the world population has grown, these problems have all increased.

Thus, a need has arisen for a watercraft with a propulsion system that addresses the foregoing issues.

SUMMARY

In accordance with a first aspect of the present disclosure, a watercraft is provided which comprises a hull, a propeller operable to propel the watercraft through a body of water, an air motor operative to rotate the propeller, an air storage tank in fluid communication with the air motor, and an air compressor operable to selectively supply compressed air to the air storage tank. In accordance with certain examples, the watercraft further comprises an air control valve having an inlet in fluid communication with the air storage tank and an outlet in fluid communication with the air motor, wherein the air control valve is operable to adjust an air flow rate to the air motor, thereby adjusting a speed of rotation of the propeller. In accordance with the same or other examples, a pneumatic control unit is provided which comprises the air control valve and at least one lever operable to adjust a flow rate of air to the air motor and move the watercraft forward (a first direction along a first axis) and in reverse (a second direction along the first axis).

In accordance with a second aspect of the present disclosure, a watercraft is provided which comprises a hull, a propeller operable to propel the watercraft through a body of water, an air motor operative to rotate the propeller, and an air compressor operable to supply compressed air to the air motor, wherein the watercraft does not include a fossil fuel engine or fossil fuel tanks. In accordance with certain examples, an air control valve and at least one lever operable to adjust a flow rate of air to the air motor and move the watercraft forward and in reverse is provided. In accordance with the same or other examples, the watercraft further comprises an air storage tank in fluid communication with the air motor, wherein the compressor is operable to supply compressed air to the air storage tank.

In accordance with a third aspect of the present disclosure, a method of propelling a watercraft through a body of water is provided. The method comprises providing at least one air motor operatively connected to a propeller positioned beneath a surface of the body of water, supplying air from at least one air storage tank to the at least one air motor until a pressure in the at least one air storage tank reaches a selected minimum pressure, supplying compressed air to the at least one air storage tank, thereby increasing the pressure in the at least one air storage tank, and ceasing the supplying of compressed air to the at least one air storage tank when the pressure in the at least one air storage tank reaches a pre-selected maximum pressure.

The disclosure will now be described, by way of example, with reference to the accompanying drawings, in which:

BRIEF DESCRIPTION OF THE DRAWINGS

The disclosure will now be described, by way of example, with reference to the accompanying drawings, in which.

DETAILED DESCRIPTION

The Figures illustrate examples of a watercraft and a compressed air propulsion system. Based on the foregoing, it is to be generally understood that the nomenclature used herein is simply for convenience and the terms used to describe the invention should be given the broadest meaning by one of ordinary skill in the art. Unless otherwise specified, like numerals refer to like components herein.

Figure 1:
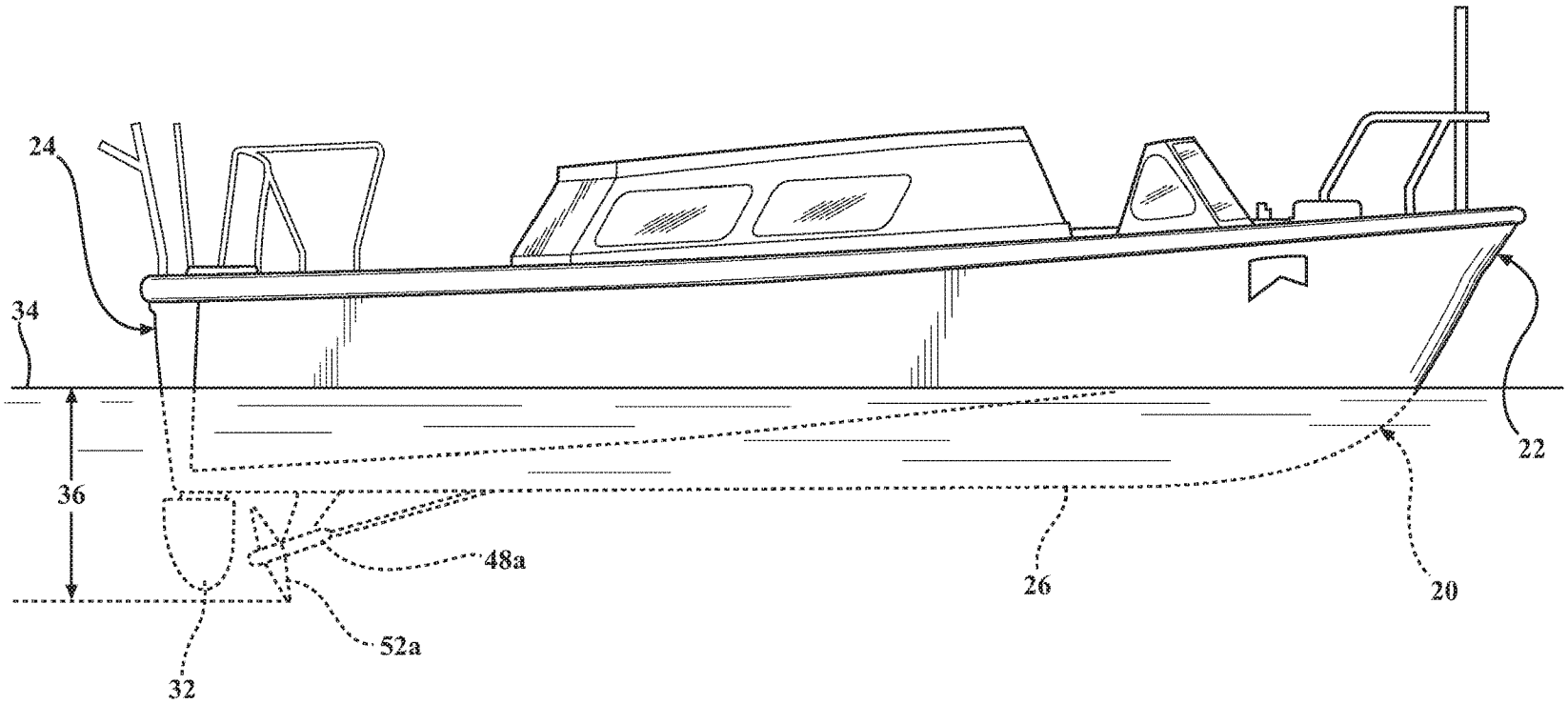
FIG. 1 is a side elevational view of a watercraft with an air propulsion system in accordance with the present disclosure.

Referring to FIG. 1, a watercraft 10 is depicted, which is a fishing boat. Watercraft 10 comprises a hull 20 which includes a bow 22 and a stern 24, as well as a keel 26. A distance between bow 22 and stern 24 along the x-axis defines the length of the watercraft. A rudder 32 projects away from the keel 26 and is used to steer the watercraft 10. Watercraft 10 comprises at least one propeller that is operable to propel the watercraft 10 through the water. In FIG. 1 the at least one propeller is propeller 52*a* and propeller 52*b* (not shown in FIG. 1). Propeller 52*a* is spaced apart from the keel 26 and below waterline 34 (when watercraft 10 is in a body of water). A distance along the z axis from the rudder to the waterline defines draft 36. At least one air motor is provided to rotate the at least one propeller.

Propeller 52*a* is operatively connected to a rotatable shaft 48*a* which rotates along its lengthwise axis l to rotate propeller 52*a* within the body of water. The rotation of propeller 52*a* within the water propels the watercraft 10 in a direction defined by the direction of rotation of propeller 52*a*, the geometry of the propeller blades, and the orientation of rudder 32.

Figure 2:
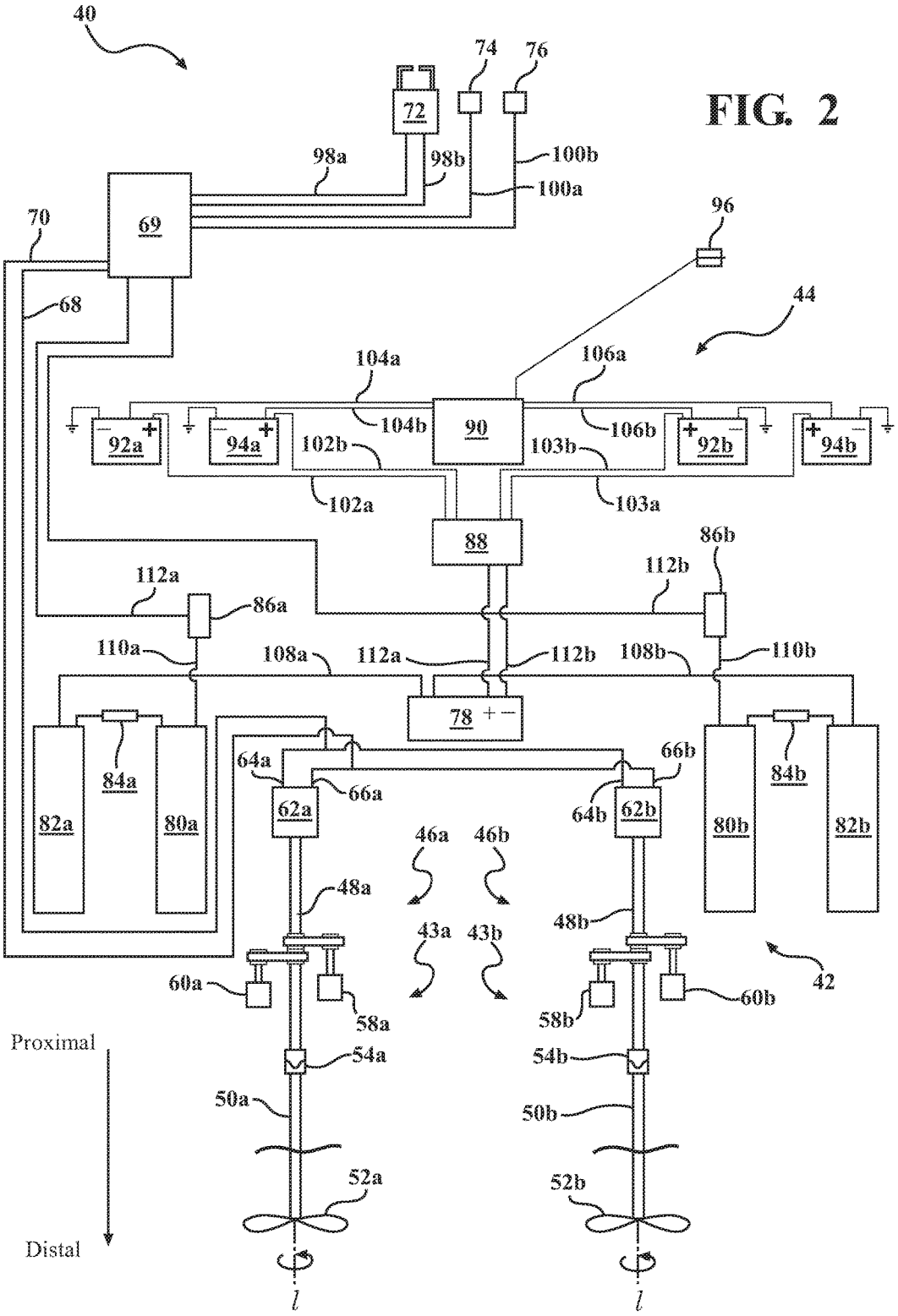
FIG. 2 is a schematic of the air and electric propulsion system of the watercraft of FIG. 1.

Unlike many current watercraft, watercraft 10 is not powered by a fossil fuel engine and does not include a fossil fuel engine or fossil fuel tanks. Instead, an air motor is provided which is operative to rotate the propeller. Referring to FIG. 2, air propulsion system 40 is provided which includes a propeller train 42, an air supply system 43 and a rechargeable battery system 44. A control system 45 is also provided. Air supply system 43 includes at least one compressed air storage tank which is in selective fluid communication with the at least one air motor as well as at least one compressor that is operable to selectively supply compressed air to the at least one air storage tank.

In FIG. 2 the at least one propeller used to propel watercraft 10 through the water comprises two propellers 52*a* and 52*b*. Propeller train 42 comprises two parallel propeller systems 43*a* and 43*b*. Each propeller system 43*a* and 43*b* further comprises a respective propeller shaft assembly 46*a* and 46*b* and respective propeller 52*a* and 52*b*. Propeller shaft assembly 46*a* is a multi-segment shaft that comprises a proximal propeller shaft section 48*a* and a distal propeller shaft section 50*a*. The proximal propeller shaft section 48*a* and distal propeller shaft section 50*b* are connected by a coupling 54*a*. The proximal end of the propeller shaft assembly 46*a* is defined by the proximal end of the proximal propeller shaft section 48*a* and is connected to air motor 62*a*. The distal end of propeller shaft assembly 46*a* is defined by the distal end of distal propeller shaft section 50*a* and is connected to propeller 52*a*. Similarly, propeller shaft assembly 46*b* is a multi-segment shaft that comprises a proximal propeller shaft section 48*b* and a distal propeller shaft section 50*b*. The proximal propeller shaft section 48*b* and distal propeller shaft section 50*b* are connected by a coupling 54*b*. The proximal end of the propeller shaft assembly 46*b* is defined by the proximal end of the proximal propeller shaft section 48*b* and is connected to air motor 62*b*. The distal end of propeller shaft assembly 46*b* is defined by the distal end of distal section 50*b* and is connected to propeller 52*b*. Each propeller shaft assembly 46*a* and 46*b* has a length along a length axis l. When its respective air motor 62*a* or 62*b* is activated, each shaft assembly 46*a* and 46*b* rotates about its respective length axis l as indicated by the curved arrows. The shaft rotation causes each respective propeller 52*a* and 52*b* to rotate about its length axis l and move the watercraft 10 through the water.

As mentioned above, air motors 62*a* and 62*b* are operable to rotate their respective propeller shaft assembly 46*a* or 46*b* and their respective propeller 52*a* or 52*b*. Air motors take compressed air and allow it to expand to do mechanical work. Air motors may be linear or rotary depending on the type of mechanical work required. In the case of air motors 62*a* and 62*b*, rotary air motors are preferred. The specific rotational frequency of the propeller and horsepower will depend on the weight of the watercraft 10 and the desired speed of travel. In one example, a rotary air motor is used. Suitable, commercially-available, rotary air motors include the 1UP-NRV-15 rotary air motor provided by Gast Manufacturing, Inc. of Benton Harbor, Mich. This motor provides 0.45HP and a torque of 5.25 in-lb at a maximum (no load) rotational speed of 6000 RPM. It also provides a speed of 500 RPM at a maximum torque of 6.0 lb-in. The motor also has a maximum air consumption of 27 cubic feet per minute. The shaft diameter is ⅜ inches, and the air inlet port size is ⅛" NPT. It is rated for a maximum pressure of 80 psig.

The air used to run the air motors 62*a* and 62*b* is provided by air supply system 43. Air supply system 43 comprises air compressor 78 and a plurality of in-line air-storage tanks 80*a*, 82*a*, 80*b*, and 82*b*. The term "in-line" refers to the fact that each pair of storage tanks (80*a*/82*a* and 80*b*/82*b*) is in the flow path from the compressor 78 to the air motors 62*a* and 62*b*. The pairs of storage tanks—80*a*/82*a* on the one hand and 80*b*/82*b* on the other hand—are in parallel with respect to one another, but are each in the flow path from a compressor discharge line (108*a* and 108*b*, respectively) to the air motors 62*a* and 62*b*. Put differently, the storage air storage tanks 80*a*, 82*a*, 80*b*, 82*b* do not supply air motors 62*a* and 62*b* in parallel with the compressor 78. One or more auxiliary air compressors (not shown) may also be provided to provide supplemental air and ensure that the air motors 62*a* and 62*b* have sufficient air flow rates while at the same time ensuring that the air-storage tanks 80*a*, 82*a*, 80*b*, and 82*b* can be refilled after reaching a desired state of depletion (e.g., a threshold lower pressure limit).

The air compressor 78 discharges to and is in fluid communication with parallel slave air storage tanks 82*a* and 82*b* via compressor discharge lines 108*a* and 108*b*. Each slave air storage tank 82*a* and 82*b* is fluidly coupled to and in fluid communication with a respective master air storage tank 80*a* and 80*b* by a respective pressure drop valve 84*a* and 84*b*. The pressure drop valves 84*a* and 84*b* ensure that the slave air storage tanks 82*a* and 82*b* operate at a higher pressure than their corresponding master air storage tanks 80*a* and 80*b*, ensuring that air flows from the slave air storage tanks 82*a* and 82*b* to their corresponding master air storage tanks 80*a* and 80*b* but not in reverse, such as when the slave air storage tanks 82*a* and 82*b* are being refilled. The extra pressure drop forces the compressor 78 to run at a higher discharge pressure and lower flow rate than it otherwise would, which prevents oversupplying air to the air motors 62*a* and 62*b*. The pressure drop valves 84*a* and 84*b* can be control valves, pressure regulators, check valves, etc. However, in certain examples they are not automatically manipulable to achieve a desired pressure, but rather, just provide s source of pressure drop in the system and adjust the operation of the compressor to a higher discharge pressure regime. In certain examples, the pressure drop across each pressure drop valve is from about 1000 psig to about 4000 psig, preferably from about 1500 psig to about 3500 psig, still more preferably from about 2000 psig to about 3000 psig, and still more preferably from about 2400 psig to about 2600 psig.

In preferred examples, the air compressor 78 is run periodically to fill the slave air storage tanks 82*a* and 82*b* until their respective pressures reach a desired maximum pressure ($P_{max}$). Filling slave air storage tanks 82*a* and 82*b* will also cause master air storage tanks 80*a* and 80*b* to fill with air. Such periodic refilling operations are carried out when the pressure in the slave air storage tanks 82*a* and 82*b* reaches a predefined lower limit ($P_{min}$). A low pressure switch may be installed on the slave air storage tanks 82*a* and 82*b* to determine when the predefined lower pressure limit $P_{min}$ has been reached. Alternatively, hardware or firmware in the control unit 69 may use pressure signals provided from pressure sensors in slave air storage tanks 82*a* and 82*b* to determine if the pressures have fallen below $P_{min}$. Among other benefits, periodic (as opposed to continuous) operation of the compressor 78 allows watercraft 10 to run more quietly for long stretches of time (e.g., when the compressor is off). In certain examples, $P_{min}$ is no less than about 1500 psig, preferably not less than about 1700 psig, and more preferably not less than about 1900 psig. In the same or other examples, $P_{min}$ is no more than about 2500 psig, preferably not less than about 2200 psig, and more preferably not less than about 2100 psig.

The in-line slave air storage tanks 82*a* and 82*b* are preferably maintained at an operating pressure that is above a first specified threshold value, which is a pre-defined lower limit ($P_{min}$) and below a second specified threshold value, which is a pre-defined upper limit ($P_{max}$). The predefined lower limit $P_{min}$ is preferably high enough to ensure that a desired air flow rate to the air motors 62*a* and 62*b* can be maintained at a desired air inlet pressure at the air motors 62*a* and 62*b*. Rotary air motors 62*a* and 62*b* have characteristic curves that relate the speed of rotation of the motor to the air motor inlet pressure and volumetric flow rate. The in-line air storage tanks 80*a*/80*b* and 82*a*/82*b* ensure that the desired combination of volumetric air flow rate and air motor inlet pressure can be maintained so that the desired speed of propeller rotation can be achieved. Also, the tanks 80*a*/80*b* and 82*a*/82*b* are preferably pre-filled to the maximum desired tank pressure ($P_{max}$) before a trip. As a result, the compressor 78 may run only periodically. However, when compressor 78 is running, it is preferred that the compressor discharge flow rate (mass of air) exceeds the rate of consumption by air motors 62*a* and 62*b* so that the tanks 80*a*, 80*b* and 82*a*, 82*b* are replenished. Nevertheless, even during refilling operations, the air motors 62*a* and 62*b* may periodically consume more air than the compressor 78 provides as long as on average the air motors 62*a* and 62*b* consume less air than is being provided by compressor 78. Thus, the in-line air storage tanks 80*a*, 80*b*, 82*a*, 82*b* provide greater flexibility in adjusting the speed of the boat by providing surge volumes and reserve volumes of air.

In certain examples, the desired maximum slave tank 82*a*, 82*b* air pressure $P_{max}$ is at least about 3000 psig, preferably at least about 4000 psig, and more preferably at least about 4200 psig. $P_{max}$ is preferably no greater than about 6000 psig, preferably no greater than about 5000 psig, and more preferably not greater than about 4600 psig. In the same or other examples, the volume of each slave tank 82*a*, 82*b* and master tank 80*a* and 80*b* is at least about 350 cubic feet, preferably about 380 cubic feet, and more preferably about 440 cubic feet, and the volume is no more than about 530 cubic feet, preferably no more than about 500 cubic feet, and more preferably not more than about 450 cubic feet. One exemplary type of air storage tank useful as master tanks 80*a*, 80*b* and slave tanks 82*a*, 82*b* is the NUVT4500 storage tank supplied by Nuvair of Oxnard, Calif. The tank has a maximum service pressure of 4500 psig, and an internal storage volume of 437 cubic feet.

The air compressor 78 takes air from the atmosphere and compresses it to a pressure sufficient to supply the master and slave tanks 80*a*/80*b* and 82*a*/82*b* until the slave air storage tanks 82*a* and 82*b* reach their desired maximum pressure ($P_{max}$) during a refilling operation. A high pressure switch may be provided to determine when $P_{max}$ has been reached. The switch may be a hardware switch installed on each slave air storage tank 82*a* and 82*b* or a software or firmware switch in a controller within power distribution panel 88 which receives pressure sensor signals from sensors installed on the slave air storage tanks 82*a*, 82*b*. In either configuration, the controller uses an input signal or signals to determine whether to turn off the compressor 78 motor. In the case of multiple slave air storage tanks 82*a*, 82*b*, the compressor 78 may be turned off when either slave tank 82*a*, 82*b* reaches $P_{max}$. Alternatively, the compressor 78 may remain on until both slave air storage tanks 82*a* and 82*b* reach $P_{max}$. However, the former approach is preferred as it prevents overfilling the slave air storage tanks 82*a*, 82*b* if one of the pressure sensors or switches fails. Suitable commercially available air compressors include the Bauer Model No. 100 air compressor which has a maximum air discharge pressure of about 5000 psig.

Compressor 78 discharges compressed air to slave air storage tank 82*a* via compressor discharge line 108*a* and to slave tank 82*b* via compressor discharge line 108*b*. In some examples, the air compressor 78 can supply air at a mass flow rate in excess of the rate of consumption of air by the air motors 62*a* and 62*b* at their maximum speed of operation and at the maximum desired compressor discharge pressure. In that case, as the slave air storage tanks 82*a* and 82*b* are being refilled (when their pressures hit the desired low pressure limit $P_{min}$), the rate at which compressed air is added to the slave air storage tanks 82*a* and 82*b* by compressor 78 will exceed the rate at which air is consumed by the air motors 62*a* and 62*b* so that the amount of air in the master 80*a*/80*b* and slave 82*a*/82*b* tanks will increase until the slave air storage tank 82*a* and 82*b* pressures read the desired upper limit $P_{max}$.

The slave air storage tanks 82*a*, 82*b* are maintained at a pressure that varies between a first selected value (the predefined minimum pressure ($P_{min}$)) and a second selected value (the predefined maximum pressure ($P_{max}$)). If air is flowing to the air motors 62*a* and 62*b*, the pressure in the master air storage tanks 80*a* and 80*b* will be less than the pressure in the slave air storage tanks 82*a* and 82*b*. The air pressure in the slave 82*a*, 82*b* and master 80*a*, 80*b* tanks will be significantly higher than the pressure required at the air motors 62*a* and 62*b* because it is desirable to maximize the amount of air with which the master tanks 80*a*/80*b* and slave tanks 82*a*/82*b* are pre-filled while still regulating the air flow rate to air motors 62*a* and 62*b* so that the watercraft 10 speed may be controlled. In order to regulate the air flow rate to the air motors 62*a* and 62*b*, the pressure must be reduced significantly from the pressure in storage tanks 80*a*/80*b* and 82*a*/82*b*. In the first instance, pressure drop valves 84*a* and 84*b* drop the air pressure significantly. In addition, however, pressure regulators 86*a* and 86*b* (fixed or adjustable valves that drop the air pressure) are provided downstream of the master air storage tanks 80*a* and 80*b*. Master air storage tank discharge line 110*a* is connected to regulator 86*a* and master air storage tank discharge line 110*b* is connected to regulator 86*b*. The regulators 86*a* and 86*b* control the inlet air pressure to pneumatic control unit 69. In certain examples, the regulators 86*a* and 86*b* control the control unit 69 inlet pressure to from about 80 psig to about 120 psig, preferably from about 90 to about 110 psig, and more preferably from about 95 to about 105 psig. In one specific example, 100 psig is used.

The pneumatic control unit 69 includes compressed air discharge lines 68 and 70. The air pressure supplied to air motors 62*a* and 62*b* via discharge lines 68 and 70 is adjustable using throttle 72. Compressed air discharge line 68 is a forward line that is connected, preferably in parallel to air motor forward rotation inlet port 64*a* of air motor 62*a* and air motor forward rotation inlet port 64*b* of air motor 62*b*. Compressed air discharge line 70 is a reverse line that is connected, preferably in parallel, to air motor reverse rotation inlet ports 66*a* and 66*b* of air motor 62*b* One or more internal air control valves within control unit 69 adjust the air pressure in discharge lines 68 and 70 based on the throttle 72 position. The throttle 72 includes two levers which can be manipulated to cause the watercraft 10 to go forward and in reverse by causing air to be selectively supplied from forward line 70 or reverse line 68 (i.e., the throttle 72 is operable to adjust the air flow rate and propeller rotational direction). Supplying air to the air motor forward rotation inlet ports 64*a* and 64*b* causes gears in air motors 62*a* and 62*b* to rotate in a first direction, which in turn causes propellers 52*a* and 52*b* to rotate in a first direction about the propeller shaft length axes 1, propelling the watercraft 10 forward. Supplying air to air motor reverse rotation air inlet ports 66*a* and 66*b* causes gears in air motors 62*a* and 62*b* to rotate in a second direction, which in turn causes propellers 52*a* and 52*b* to rotate in a second direction about the propeller shaft length axes 1, propelling watercraft 10 in reverse. The levers on throttle 72 are manipulable to rotate the propellers 52*a* and 52*b* in forward and reverse from a speed of zero to the maximum rate of rotation of the air motors 62*a* and 62*b*. In one example, the supply pressure to the air motors 62*a* and 62*b* ranges from 0 to 100 psig, which corresponds to a propeller rotational frequency of from 0 to about 400 rpm.

Throttle 72 includes wires 98*a* and 98*b* which send a control signal to the control unit 69 to cause control unit 69 to adjust the controller discharge pressure in lines 68 and 70 via internal air control valves. Thus, the master air storage tanks 80*a* and 80*b* are in fluid communication with the air motors 62*a* and 62*b* via the pressure regulators 86*a* and 86*b* and the air control valves in the control unit 69. In certain examples, the compressed air pressure in compressed air discharge lines 68 and 70 ranges from 0 to about 100 psig.

Control unit 69 is also operatively connected to indicators 74 and 76. Indicators 74 and 76 provide a visual indication of the frequency of rotation of each propeller 52*a* and 52*b* (e.g., RPM) based on appropriate instruments connected to the propeller shaft assemblies 46*a* and 46*b* or the air motors 62*a* and 62*b*. Indicator lines 100*a* and 100*b* provide electrical signals necessary to operate the indicators 74 and 76 and are in electrical communication with air motors 62*a* and 62*b* or other devices used to indicate the speed of rotation of the shaft assemblies 46*a* and 46*b*.

Air compressor 78 (and an auxiliary compressor, if provided) is preferably capable of being powered by battery power. A plurality of batteries 92*a*, 92*b*, 94*a*, and 94*b* are provided to supply electrical energy necessary to operate air compressor 78. The positive terminals of batteries 92*a* and 94*a* are connected to a power distribution panel 88 via electrical connection lines 102*a* and 102*b*, respectively, and the negative terminals of batteries 92*a* and 94*a* are connected to ground. The positive terminals of batteries 92*b* and 94*b* are connected to power distribution panel 88 via electrical connection lines 103*a* and 103*b*, and the negative terminals of batteries 92*b* and 94*b* are connected to ground. The power distribution panel 88 is connected to a positive terminal of the air compressor 78 electric motor via connection 112*a* and to a negative terminal of the air compressor 78 electric motor via connection 112*b*. The power distribution panel 88 selects one from among the four batteries 92*a*, 94*a*, 92*b*, 94*b* at a time to supply power to compressor 78.

The batteries 92*a*, 94*a*, 92*b*, 94*b* are preferably rechargeable and are each preferably capable of supplying the energy needed to cyclically operate compressor 78. Suitable examples include lithium iron phosphate batteries. The batteries 92*a*, 94*a*, 92*b*, 94*b* are preferably selected to provide a voltage compatible with the requirements of the compressor 78 motor and a capacity sufficient to ensure that electric power is sufficient to allow watercraft 10 to remain at sea for a desired period at a desired speed without recharging. In one example, four (4) size 8D lithium iron phosphate batteries supplied by RELi$^3$ON® of Fort Mill, S.C. are used. The batteries 92*a*, 94*a*, 92*b*, 94*b* are connected to a recharging panel 90 via recharging lines 104*a*, 104*b*, 106*a*, and 106*b*. Recharging panel 90 is connected to a 96 for connecting recharging panel 90 to a dock power source. When watercraft 10 is in port, plug 96 may be connected to a power source to recharge batteries 92*a*, 94*a*, 92*b*, and 94*b*.

In certain examples, the kinetic energy of the rotating propeller shaft assemblies 46*a* and 46*b* is converted to electrical energy for use by other electrically-powered systems onboard watercraft 10. In one implementation, alternators 58*a*, 58*b*, 60*a*, 60*b* are connected to each shaft assembly 46*a* and 46*b* and convert a portion of the rotating shaft kinetic energy to electrical energy. The electrical current supplied by the alternators 58*a*, 58*b*, 60*a*, 60*b* is then supplied to the power distribution panel 88. The power distribution panel 88 can then supply the current to recharge accessory batteries used to run lights, horns, radios, etc.

In certain implementations, propulsion system 40 is used to retrofit a watercraft 10, from which an existing fossil fuel engine and fossil fuel tanks have been removed. The present disclosure reflects the surprising discovery that watercraft with compressed air propulsion systems of the type described herein can be used to propel watercraft 10 for longer periods of time than a fossil fuel powered engine operating at the same speed with all of its tanks full of fossil fuel. In certain implementations, the components forming the propulsion system 40 allow watercraft 10 to remain at sea longer than the watercraft 10 with the fossil fuel engine and fuel tanks while weighing significantly less than the removed fossil fuel tanks and engines, fossil fuel, and engine. In certain examples, a retrofitted watercraft 10 with a compressed air propulsion system 10 which has sufficient battery power to remain at sea longer than the original watercraft 10 with fossil fuel engines and tanks would be so much lighter than the original watercraft 10 that it would require ballast to provide the necessary list and trim. However, additional batteries such as batteries 92*a*, 94*a*, 92*b*, and 94*be* may be installed and used both as ballast and as a source of additional electricity, allowing watercraft 10 to remain at sea even longer.

A method of operating watercraft 10 will now be described. Watercraft 10 is initially docked. Compressed air storage tanks 80*a*/80*b* and 82*a*/82*b* are filled with air until the slave air storage tanks 82*a* and 82*b* reach their desired maximum pressure $P_{max}$. As air motors 62*a* and 62*b* are initially off, the master tanks 80*a* and 80*b* will be at the same pressure as their respective slave tanks 82*a* and 82*b*. In the case of NUVT4500 tanks, the maximum pressure is the service pressure of 4500 psig. At this point, pressure regulators 86*a* and 86*b* are set to supply a desired air pressure (e.g., 100 psig) to control unit 69 supply lines 112*a* and 112*b*. However, internal valves in control unit 69 are closed and supply no air to the air motors 62*a* and 62*b* (e.g. 0 psig). Batteries 92*a*, 94*a*, 92*b*, 94*b* are fully charged. After unmooring the watercraft 10, throttle 72 is actuated to transmit air pressure via forward rotation line 68 to air motor forward rotation input ports 64*a* and 64*b*, with the position of the throttle corresponding to both the pressure in forward rotation line 70 and the rotational frequency of propellers 52*a* and 52*b*.

After the journey has progressed for a period of time, the air pressure in slave air storage tanks 82*a* and 82*b* drops to a first selected value, the desired minimum pressure $P_{min}$. At this point, a controller in the power distribution panel 88 electrically connects one of the batteries 92*a*, 94*a*, 92*b*, 94*b* to an electric motor that drives compressor 78 and/or activates the electric motor that runs compressor 78. Compressor 78 intakes and compresses ambient air, causing it to flow to the slave air storage tanks 82*a* and 82*b* and then into the master air storage tanks 80*a* and 80*b*. Alternatively, the regulators 86*a* and 86*b* can be configured and/or controlled to allow only one tank pair 80*a*/82*a* or 80*b*/82*b* to be used at any one time. Once the pressure in the slave air storage tanks 82*a* and 82*b* reaches a second selected value, the maximum desired pressure $P_{max}$, the compressor 78 is turned off (such as by discontinuing the supply of electric power from power distribution panel 88). If the pressures in slave air storage tanks 82*a* and 82*b* are different, the system may be configured to turn off compressor 78 when either slave tank 82*a* or 82*b* reaches the maximum desired pressure $P_{max}$. While the system could be configured to keep the compressor 78 running until both slave tanks 82*a*, 82*b* reach $P_{max}$, it is preferred to turn the compressor 78 off when one of them reaches $P_{max}$ to prevent overfilling if one of the pressure sensors or switches fails.

This process of cycling the compressor 78 on and off as the pressure drops and rises in the slave tanks 82*a*, 82*b* is repeated. Eventually, the currently operative battery from among batteries 92*a*, 94*a*, 92*b*, 94*b* drops to a potential difference that is low enough to cause the controller in the power distribution panel 88 to place another one of the batteries 92*a*, 94*a*, 92*b*, 94*b* in electrical communication with the motor in compressor 78. Moreover, during the entire journey, no fossil fuels are consumed and no carbon dioxide, carbon monoxide, water, NOx, SOx or other pollutants are emitted.

EXAMPLE

A 1972 Luhrs Sport Fishing Boat weighing approximately 19,000 lbs. is provided. The boat includes two Chrysler 318 cc engines. Including the reverse and reduction gears, the engines weigh approximately 900 lbs. each. Two 75 gallon gas tanks are also included, which collectively weigh about 250 lbs. empty. 150 gallons of gasoline weighs approximately 1,100 lbs. Thus, the total weight of the gasoline engines, gas tanks, and gasoline is about 3150 lbs. The boat is retrofitted with a propulsion system in accordance with propulsion system 40 of FIG. 2.

The Chrysler engines, the gas tanks, and the gas are removed from the vessel. Four Nuvair NUVT4500 compressed air storage tanks are installed in the vessel, each of which has an empty weight of about 145.5 lbs. The tanks include a supporting aluminum assembly weighing almost 350 lbs.

Two GAST 1UP-NRV-15 rotary air motors are installed as shown in FIG. 2. One commercially available main compressor weighing about 800 lbs. and two commercially available auxiliary compressors weighing about 400 lbs. each are also installed. The compressors are selected to have a maximum discharge pressure of about 4500 psig and to supply a flow rate or air to both air tanks 80*a*, 82*a*, 80*b*, and 82*b* which exceeds the amount of air consumed by air motors 62*a* and 62*b* when watercraft 10 is at a cruising speed of 15-18 miles per hour. The weight of each motor 62*a* and 62*b* is approximately 25 lbs. Twelve RELi$^3$ON® lithium iron phosphate 12V, size 8D batteries weighing approximately 83 lbs each are installed. The boat has an existing control panel and power distribution panel which are rewired and outfitted with pneumatic lines for use with air motors.

The retrofitted components weigh about 570 lbs more than the removed components. However, prior to retrofitting, when watercraft 10 is cruising at a speed of about 15-18 miles per hour, it consumes about 7 gallons of gasoline per hour, which will exhaust the full 150 gallon fuel supply in about 21.4 hours. In contrast, each of the 12 lithium iron phosphate batteries is estimated to be able to run the main and auxiliary compressors for 72 hours continuously, even though in operation, the compressors will only be run periodically (i.e., when the slave tank 82*a*, 82*b* pressures fall below $P_{min}$). With 12 lithium iron phosphate batteries of the type described above, even if the main and auxiliary compressors were operating continuously, the air motors could be operated continuously for about 36 days (874 hours) while moving watercraft 10 at a speed of about 15-18 miles per hour through the water. Thus, air propulsion systems in accordance with the present disclosure provide the ability to stay at sea for more than 30 times as long as a fossil fuel engine and fuel system sized for the same watercraft.

If only one of the twelve (12) lithium iron phosphate batteries were used, watercraft 10 could still remain at sea more than three times as long with the air propulsion system of the present disclosure than with the replaced fossil fuel system and the retrofitted watercraft 10 would weigh over 300 lbs. less than the original watercraft. Thus, it has surprisingly been discovered that not only can air propulsion systems built in accordance with the present disclosure avoid the burning of fossil fuels, but they can allow the watercraft to remain at sea far longer than fossil fuel engines. It has also been discovered that adding lithium iron phosphate batteries also helps maintain the list and trim of the watercraft 10.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. A watercraft, comprising:

a hull;

a propeller operable to propel the watercraft through a body of water;

an air motor operative to rotate the propeller;

an air storage tank in selective fluid communication with the air motor; and an air compressor operable to selectively supply compressed air to the air storage tank wherein the air compressor is powered by at least one battery.

2. The watercraft of claim 1, further comprising:

an air control valve having an inlet in fluid communication with the air storage tank and an outlet in fluid communication with the air motor, wherein the air control valve is adjustable to adjust an air flow rate to the air motor, thereby adjusting a speed of rotation of the propeller.

3. The watercraft of claim 2, further comprising a pneumatic control unit comprising the air control valve, and at least one lever operable to adjust a flow rate of air to the air motor and move the watercraft in forward and reverse.

4. The watercraft of claim 1, further comprising:

one or more accessory batteries electrically connected to at least one selected from a horn, lights, and a radio;

a propeller shaft having a first end and a second end, wherein the first end of the propeller shaft is coupled to the air motor and the second end of the propeller shaft is coupled to the propeller;

an alternator connected to the at least one battery and the propeller shaft and operable to charge the one or more accessory batteries when the propeller shaft rotates.

5. The watercraft of claim 1, wherein the at least one battery is at least one lithium iron phosphate battery.

6. The watercraft of claim 1, wherein the at least one battery comprises a plurality of lithium iron phosphate batteries.

7. The watercraft of claim 1, further comprising:

four primary lithium iron phosphate batteries, wherein the four primary lithium iron phosphate batteries include the at least one battery; and ballast comprising a plurality of spare lithium iron phosphate batteries having a collective weight of at least about 500 lbs.

8. The watercraft of claim 1, wherein the watercraft does not include a fossil fuel engine or fossil fuel tanks.

9. A watercraft, comprising:

a hull;

a propeller operable to propel the watercraft through a body of water;

an air motor operative to rotate the propeller;

an air storage tank in selective fluid communication with the air motor; and an air compressor operable to selectively supply compressed air to the air storage tank, wherein the air storage tank is a master air storage tank, the watercraft further comprising a slave air storage tank, wherein the master air storage tank has an inlet line and an outlet line, the slave air storage tank has an inlet line and an outlet line, the compressor has a discharge line in fluid communication with the slave air storage tank inlet line, the slave air storage tank outlet line is in fluid communication with the master air storage tank inlet line via a pressure drop valve, and the master air storage tank outlet line is in fluid communication with the air motor.

10. The watercraft of claim 9, further comprising a low pressure switch fluidly coupled to an interior volume of the slave air storage tank and operatively connected to the air compressor, such that when a pressure in the slave air storage tank falls below a first specified threshold value, the air compressor is activated to perform a slave air storage tank air refilling operation until the pressure in the slave air storage tank reaches a second specified threshold value.

11. The watercraft of claim 10, wherein the first specified threshold value is from about 1500 psi to about 2500 psig.

12. A watercraft, comprising:

a hull;

a propeller operable to propel the watercraft through a body of water;

an air motor operative to rotate the propeller;

an air storage tank in selective fluid communication with the air motor; and an air compressor operable to selectively supply compressed air to the air storage tank, wherein the air compressor has a maximum air discharge pressure of about 5000 psig.

13. The watercraft of claim 12, wherein the air storage tank has an outlet line fluidly coupled to a pressure regulator, the watercraft further comprising an air control valve in fluid communication with the air motor and the pressure regulator, wherein the pressure regulator is set to provide air to the air control valve at a pressure of no greater than 500 psig.

14. A watercraft, comprising:

a hull;

a propeller operable to propel the watercraft through a body of water;

an air motor operative to rotate the propeller; and an air compressor operable to supply compressed air to the air motor, wherein the watercraft does not include a fossil fuel engine or a fossil fuel tank, and wherein the air compressor is electrically connected to at least one battery.

15. The watercraft of claim 14, further comprising a pneumatic control panel comprising an air control valve, and at least one lever operable to adjust a flow rate of air to the air motor and move the watercraft forward or in reverse.

16. The watercraft of claim 14, further comprising:

one or more accessory batteries electrically connected to at least one selected from a horn, lights, and a radio;

a propeller shaft having a first end and a second end, wherein the first end of the propeller shaft is coupled to the air motor and the second end of the propeller shaft is coupled to the propeller;

an alternator connected to the one or more accessory batteries and the propeller shaft and operable to charge the at one or more accessory batteries when the propeller shaft rotates.

17. The watercraft of claim 14, wherein the at least one battery is at least one lithium iron phosphate battery.

18. The watercraft of claim 17, wherein the at least one lithium iron phosphate battery comprises a plurality of lithium iron phosphate batteries.

19. The watercraft of claim 14, further comprising:

at least four primary lithium iron phosphate batteries, wherein the at least four primary lithium iron phosphate batteries include the at least one battery.

20. A watercraft, comprising:

a hull;

a propeller operable to propel the watercraft through a body of water;

an air motor operative to rotate the propeller;

an air compressor operable to supply compressed air to the air motor, wherein the watercraft does not include a fossil fuel engine or a fossil fuel tank;

a master air storage tank in fluid communication with the air motor, wherein the compressor is selectively operable to supply compressed air to the master air storage tank; and a slave air storage tank, wherein the master air storage tank has an inlet line and an outlet line, the slave air storage tank has an inlet line and an outlet line, the compressor has a discharge line in fluid communication with the slave air storage tank inlet line, the slave air storage tank outlet line is fluid communication with the master air storage tank inlet line, and the master air storage tank outlet line is in fluid communication with the air motor.

21. The watercraft of claim 20, further comprising a controller and a low pressure selector fluidly coupled to the slave tank and the controller, wherein the controller is operatively connected to the air compressor, such that when a pressure in the slave tank falls below a first specified threshold value, the air compressor is cycled on until the pressure in the slave tank reaches a second specified threshold value.

22. The watercraft of claim 21, wherein the first specified threshold value is from about 1500 psig to about 2500 psig.

23. A watercraft, comprising:

a hull;

a propeller operable to propel the watercraft through a body of water;

an air motor operative to rotate the propeller; and an air compressor operable to supply compressed air to the air motor, wherein the watercraft does not include a fossil fuel engine or a fossil fuel tank, and wherein the air compressor has a maximum air discharge pressure of about 5000 psig.

24. The watercraft of claim 23, wherein the air storage tank has an outlet line fluidly coupled to a pressure regulator, the watercraft further comprising an air control valve in fluid communication with the air motor and the pressure regulator, wherein the pressure regulator is set to provide air to the air control valve at a pressure of no greater than about 500 psig.

* * * * *